US007718350B2

(12) United States Patent
Kamijima

(10) Patent No.: US 7,718,350 B2
(45) Date of Patent: May 18, 2010

(54) METHOD OF METAL PLATING BY USING FRAME

(75) Inventor: Akifumi Kamijima, Tokyo (JP)

(73) Assignee: TDK Corporation, Tokyo (JP)

( * ) Notice: Subject to any disclaimer, the term of this patent is extended or adjusted under 35 U.S.C. 154(b) by 201 days.

(21) Appl. No.: 11/677,245

(22) Filed: Feb. 21, 2007

(65) Prior Publication Data

US 2008/0199790 A1 Aug. 21, 2008

(51) Int. Cl.
*H01L 21/77* (2006.01)
*C25D 5/02* (2006.01)

(52) U.S. Cl. ..... 430/315; 430/313; 430/318; 205/118; 205/149

(58) Field of Classification Search ..... None
See application file for complete search history.

(56) References Cited

U.S. PATENT DOCUMENTS 5,721,078 A 2/1998 Kamijima
5,725,997 A 3/1998 Kamijima
5,747,198 A 5/1998 Kamijima
6,635,408 B2 10/2003 Kamijima
2003/0180633 A1 * 9/2003 Sato et al. ..... 430/5

FOREIGN PATENT DOCUMENTS

JP 2002-164368 6/2002
JP 2002-339079 11/2002

OTHER PUBLICATIONS

U.S. Appl. No. 11/674,374, filed Feb. 13, 2007, Kamijima.
U.S. Appl. No. 11/671,758, filed Feb. 6, 2007, Kamijima, et al.

* cited by examiner

*Primary Examiner*—Daborah Chacko Davis
(74) *Attorney, Agent, or Firm*—Oblon, Spivak, McClelland, Maier & Neustadt, L.L.P.

(57) ABSTRACT

The frame plating process of the invention comprises the dry film resist pattern formation step at which a part of the dry film resist is located in such a way as to cap the upper position of the given pattern of opening concavity corresponding to the site needing film thickness precision. It is thus possible to obtain a fairly good film thickness distribution at the specific site needing film thickness precision in a simple manner yet without depending on the film thickness distribution of the plated film based on plating conditions.

10 Claims, 5 Drawing Sheets

METHOD OF METAL PLATING BY USING FRAME

BACKGROUND OF THE INVENTION

1. Field of the Invention

The present invention relates generally to a frame plating process, and more particularly to a frame plating process that enables a fairly good film thickness distribution to be obtained at a specific site needing film thickness precision in a simple way yet without depending on the film thickness distribution of a plated film based on plating conditions.

2. Explanation of the Prior Art

One technique of forming a micropatterned thin film (micropattern), for instance, includes a frame plating process. According to that process, for instance, an electrode film is formed on a substrate, and a resist is formed by coating on the electrode film. Then, that resist layer is patterned by photolithography so that a frame for forming a plated film is formed by the remnants of the patterned resist (mask pattern). Thereafter, that frame is used for electroplating using the previously formed electrode layer as a seed so that a patterned thin film comprising an electroconductive material is formed.

Micropattern thin films formed by the frame plating process are used for, for instance, microparts, microlayer components, interconnecting patterns or the like that constitute, for instance, a microdevice. Exemplary micro-devices are thin-film inductors, thin-film magnetic heads, semiconductor devices, sensors using thin films, and actuators using thin films.

When a given shape of frame plated film is formed for the purpose of fabricating such microdevices, there is often a demand for only a specific area of the formed frame plated film to have an increased film thickness precision (that means that there must be a decreased fluctuation of the thickness distribution of the plated film). One possible approach to increasing the plated film thickness precision at such a specific site is to polish or otherwise smoothen that site alone; however, the operation of partial polishing or the like taking aim at a microarea alone involves much difficulty, and is impractically poor in efficiency as well.

The present invention has been made with such situations in mind, and has for the object the provision of a frame plating process that enables a good film thickness distribution to be obtained at a specific site needing film thickness precision in a simple way yet without depending on the thickness distribution of a plated film based on plating conditions.

SUMMARY OF THE INVENTION

According to the present invention, such problems as described above are solved by the provision of a frame plating process formation of a plated film having a site needing film thickness precision at which the plated film is partly required to have thickness precision, which comprises a step of providing a substrate, a step of forming an electrode film on said substrate, a resist pattern formation step of forming a resist pattern on said electrode film in such a way as to provide a given pattern of opening concavity, a dry film resist pattern formation step of locating a part of a dry film resist in such a way as to cap an upper position of said given pattern of opening concavity corresponding to the site needing film thickness precision, and a plated film formation step of growing a plated film in such a way as to fill up said given pattern of opening concavity.

In a preferable embodiment of the invention, said dry film resist pattern formation step involves laminating the dry film resist on the resist pattern including the given pattern of opening concavity, and patterning said dry film resist by photolithography, so that the upper position of said given pattern of opening concavity corresponding to the site needing film thickness precision is capped by a part of said patterned dry film resist.

In another preferable embodiment of the invention, said dry film resist pattern formation step involves using a patterned dry film resist to which patterning has previously been applied in a given pattern to apply said patterned dry film resist onto the resist pattern including the given pattern of opening concavity, so that the upper position of said given pattern of opening concavity corresponding to the site needing film thickness precision is capped by a part of said patterned dry film resist.

In yet another embodiment of the invention, there are plural such sites needing film thickness precision, and there are as many parts of the dry film resist as said plural such sites.

In a further preferable embodiment of the invention, said resist pattern formation step involves a photoresist film on one surface of the substrate, after which said photoresist film is selectively exposed to light and developed to form the resist pattern including the given pattern of opening concavity.

In a further preferable embodiment of the invention, a resist removal step of removing the resist pattern and dry film resist pattern is further added after said plated film formation step.

In a further preferable embodiment of the invention, an etching step of using the plated film as a mask to remove an unnecessary portion of the electrode film is further added after said resist removal step.

In a further preferable embodiment of the invention, there is a plated film of composite shape formed, which is made up of a combined pattern comprising the resist pattern formed on said electrode film and a pattern of the dry film resist formed at said dry film resist pattern formation step.

The frame plating process of the invention comprises the dry film resist pattern formation step at which a part of the dry film resist is located in such a way as to cap the upper position of the given pattern of opening concavity corresponding to the site needing film thickness precision. It is thus possible to obtain a fairly good film thickness distribution at the specific site needing film thickness precision in a simple manner yet without depending on the film thickness distribution of the plated film based on plating conditions.

DETAILED EXPLANATION OF THE INVENTION

The present invention is now explained with reference to the best mode for carrying out it.

The frame plating process of the invention is provided to form a plated film, a part of which has a site needing film thickness precision.

The "site needing film thickness precision" here refers to a special site (specific site) of the configuration of a given form of frame plated film formed by the process of the invention, which site is required to have improved plated film thickness precision and an extremely limited fluctuation of the plated film thickness distribution.

Figure 3:
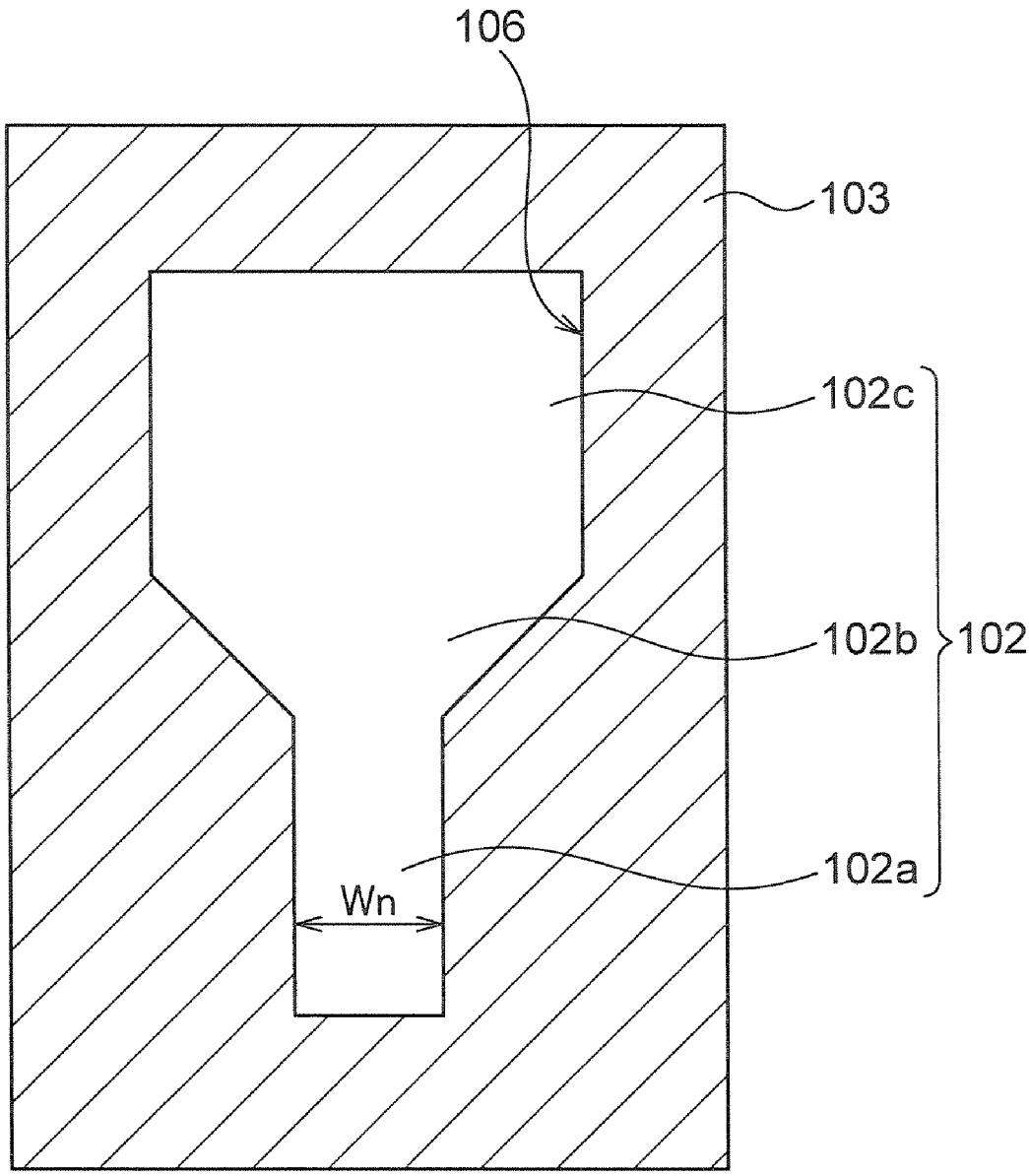
FIG. 3 is a plan view of how the frame is formed on the way through the frame plating process of the invention.

Referring to the morphology of the frame plated film formed by the process of the invention, there is the mention of a plated film that grows in the direction coming out of the drawing paper with a solid-white area 102 (electrode film 102) as a seed, as shown typically in the plan view of FIG. 3.

FIG. 3 is a plan view illustrating that the pattern of a resist frame 103 is being formed on the electrode film 102. The electrode film 102 exposed at the bottom is configured in such a way as to have a straight portion 102*a* of decreased width, a fanning portion 102*b* of increasing width, which is joined to that portion 102*a* of decreased width, and a portion 102*c* of increased yet constant width, which is joined to the fanning portion 102*b*. And, as frame plating is implemented using as an electrode the electrode film 102 configured as shown in FIG. 3, there is a substantially battledore form of frame plated film formed. Taking the morphology of this substantially battledore form of frame plated film as one preferable example of the embodiment here, the steps of the frame plating process are now explained in greater details with reference to the drawings.

In the embodiment here, the "site needing film thickness precision" of the frame plated film, which is required to have plated film thickness precision, is corresponding to a substantial middle of the straight portion 102*a* of decreased width, shown in FIG. 3. One would have a better understanding of this corresponding site by reference to the following description.

Figure 4:
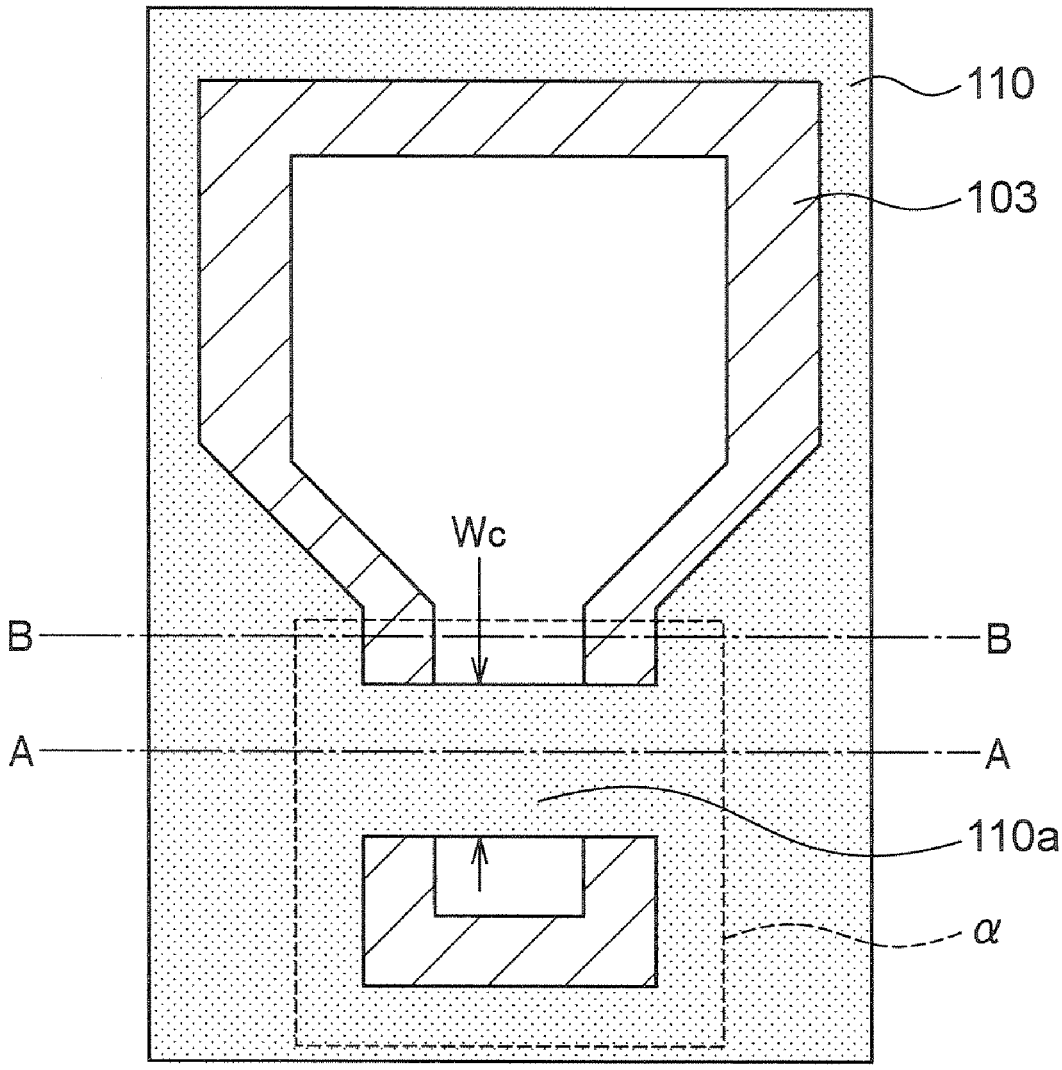
FIG. 4 is a plan view of how the pattern of the dry film resist pattern is formed on the frame after the formation of the frame in the frame plating process of the invention.
Figure 5:
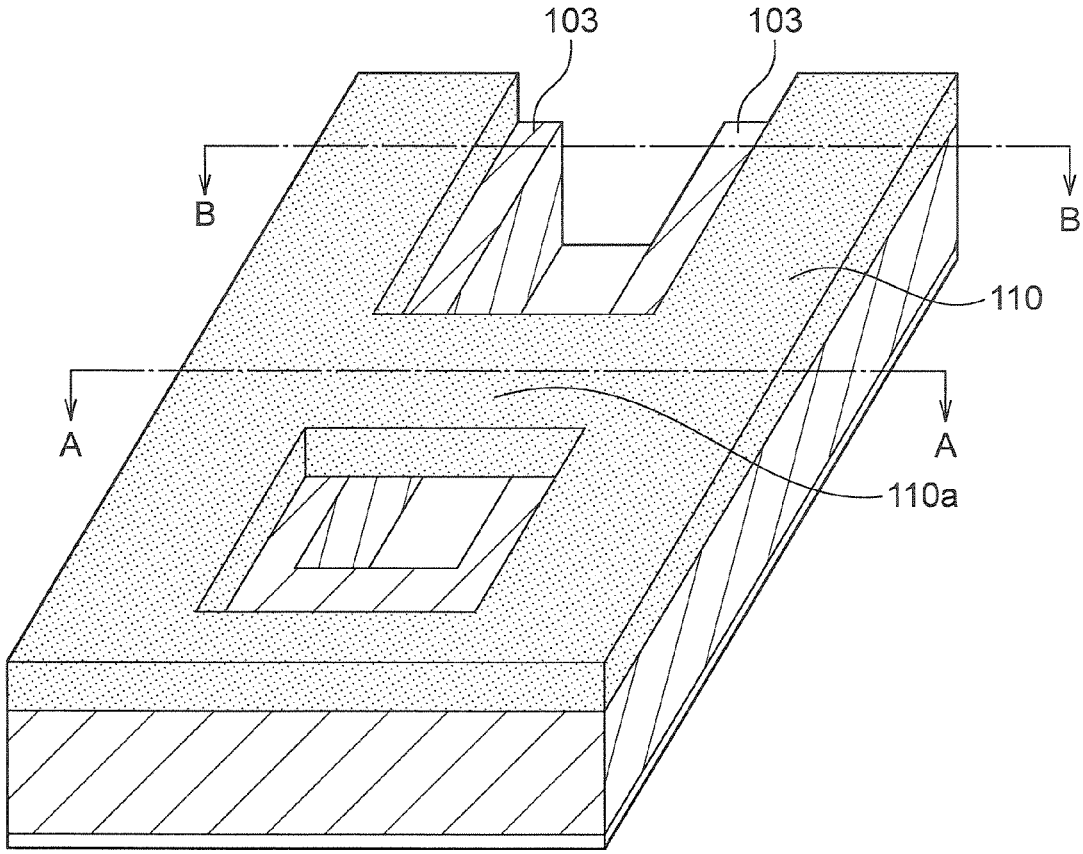
FIG. 5 is a view in which the area $\alpha$ marked off by a broken line in FIG. 4 is excerpted and redrawn in perspective.

FIGS. 1A to 1I are illustrative, in section and over time, of the frame plating process steps according to the invention; they are sectional views of the site corresponding to section A-A in FIG. 4. FIGS. 2A to 2I are illustrative, in section and over time, of the frame plating process steps according to the invention; they are sectional views of the site corresponding to section B-B in FIG. 4. FIG. 3 is a plan view of how the frame is formed on the way through the frame plating process of the invention, with reference numeral 106 standing for an opening concavity. FIG. 4 is a plan view of how the patterned dry film resist 110 is formed on the frame 103 and a part of the opening concavity 106 after the formation of the frame 103 in the frame plating process of the invention (the state of FIG. 3). FIG. 5 is a view in which the area α marked off by a broken line in FIG. 4 is excerpted and redrawn in perspective.

(1) Step of Providing a Substrate

Figure 1A:
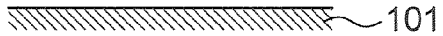
FIGS. 1A to 1I are illustrative, in section and over time, of the frame plating process steps according to the invention; they are sectional views of the site corresponding to section A-A in FIG. 4.
Figure 2A:
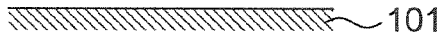
FIGS. 2A to 2I are illustrative, in section and over time, of the frame plating process steps according to the invention; they are sectional views of the site corresponding to section B-B in FIG. 4.

For the process of forming a plated film according to the invention, a substrate 101 for forming a plated film on it is first provided, as shown in FIGS. 1A and 2A. For the substrate 101, there is the mention of a silicon substrate, an AlTiC substrate, a glass substrate or the like.

It is noted that for the substrate 101, various substrates or films may be used provided that they are capable of supporting the photoresist film to be described later. For instance, the plane of a multilayer structure formed on the way through the fabrication of microdevices such as thin-film inductors, thin-film magnetic heads, semiconductor devices, sensors using a thin film and actuators using a thin film may just as well be used as the substrate 101, so that the frame plating process of the invention is applied onto the multilayer structure.

(2) Step of Forming a Resist Pattern

Figure 1B:
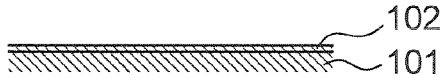
Figure 2B:
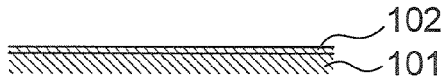

Then, the electrode film formation step is carried out to form on the substrate 101 an electroconductive electrode film 102 that provides a plating seed, as depicted in FIGS. 1B and 2B.

The electrode film 102 is formed using techniques such as sputtering or CVD, and its composition should preferably be the same as that of the plated film to be formed later. It is noted that prior to the formation of the electrode film 102, an adhesion enhancement layer such as a Cr or Ti layer may just as well be formed in advance. The electrode film 102 has a thickness of usually about 30 to 50 nm.

(3) Resist Pattern Formation Step

Figure 1C:
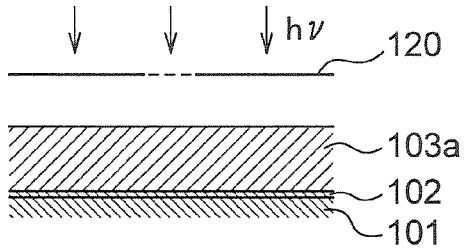
Figure 2C:
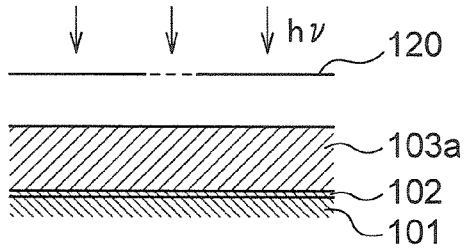

Then, there is a step implemented for forming on the electrode film 102 a resist pattern in such a way as to provide a given pattern of opening concavity. To be more specific, as depicted in FIGS. 1C and 2C, a photoresist is coated on the surface of the electrode film 102 using a coating technique such as spin coating. Thereafter, the photoresist is heated (baked), if required, into a photo-resist film 103*a*.

Figure 1D:
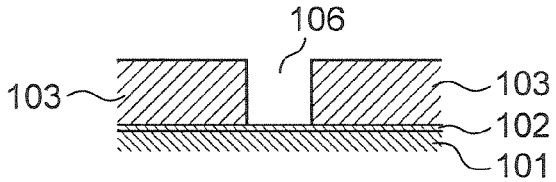
Figure 2D:
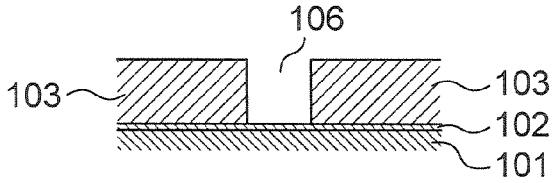

Then, photolithography is used for the patterning of the photoresist film 103*a* (selective exposure via a mask 120 and then development for patterning) to form a resist pattern 103 (frame 103), as depicted in FIGS. 1D and 2D.

The thus formed resist pattern 103 (frame 103) provides an opening concavity 106 that is generally configured into a substantially battledore form as shown in FIG. 3.

It is noted that the resist pattern 103 (frame 103) may just as well be formed using a dry film resist.

(4) Step of Forming the Dry Film Resist Pattern

Figure 1E:
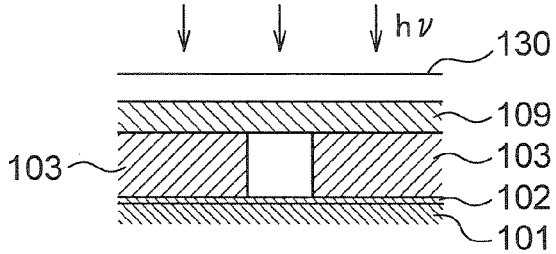
Figure 2E:
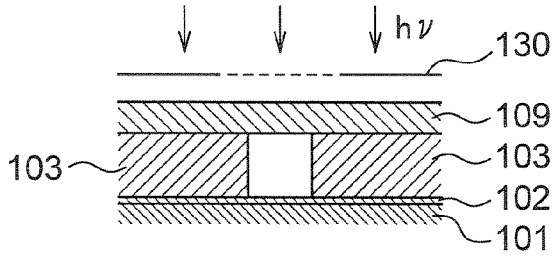

Then, at the step of forming the dry film resist pattern, a part of the resist of the resist dry film pattern is located in such a way as to cap an upper position of the given pattern of opening concavity 106 corresponding to the site needing film thickness precision, as depicted in FIGS. 1E and 2E.

That is, a dry film resist 109 is roll coated in such a way as to cap the whole of the resist pattern 103 and the opening concavity 106 delimited by that resist pattern 103.

Figure 1F:
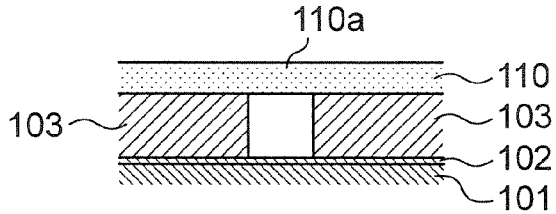
Figure 2F:
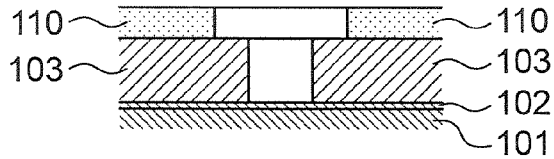

Thereafter, photolithography is used to pattern the drying film resist 109 (selective exposure via the mask 130 and development for patterning) into a dry resist pattern 110 (dry resist 110), as depicted in FIGS. 1F and 2F.

The general configuration of the formed dry resist pattern 110 (dry resist 110) is indicated by a dotted area in the plan view of FIG. 4, and an area a delimited by a broken line in FIG. 4 is excerpted and redrawn as a perspective view in FIG. 5. In FIGS. 4 and 5, a part 110*a* of the dry resist pattern 110 plays a role as a cap that is formed at the upper position of the opening concavity corresponding to the site needing film thickness precision. In the embodiment shown in FIG. 4, the part 110*a* of the dry resist pattern 110 is shown as lying at only one site, because there is only one site needing film thickness precision involved. When there are plural such sites needing film thickness precision, however, the dry resist pattern is modified in such a way that as many parts 110*a* as those sites are present.

In the embodiment here, after the roll coating of the dry film resist 109, photolithography is used to pattern the dry film resist 109. Instead of using this method, however, a previously patterned dry film resist 109 may just as well be roll coated in such a way as to cap the predetermined sites of the resist pattern 103 and opening concavity 106.

It is also contemplated that the dry film resist 109 may be previously patterned in conformity with only the morphology of the part 110*a* having a function of capping the site needing film thickness precision (in FIG. 4, for instance, suppose a morphology defined only by a bridged rectangular piece shape), and the dry film resist 109 in a rectangular piece shape may then be fixed to the site needing film thickness precision.

In the roll coating of the dry film resist 109, it is contemplated that the temperature of the substrate 101 is set at about 20 to 100° C.; the roll temperature is at a about 80 to 150%; the roll pressure is at about 0.1 to 1 MPa; and the roll speed is at about 0.5 to 3 m/min.

When exposure and development are carried out harnessing photolithography after the roll coating of the dry film resist 109, it is particularly preferable to control the exposure dose involved, because only the overlying dry film resist 109 can be printed into a given shape without having influences on the underlying resist pattern 103.

It is also noted that both types, negative and positive, may be used for the resist for the formation of the resist pattern 103 (frame 103) and the dry film resist; however, it would be preferable to use the negative type for both in consideration of the fact that both are stacked one upon another for exposure to light and development.

(5) Step of Forming the Plated Film

Then, at the step of forming the plated film, the plated film is grown in such a way as to fill up the given pattern of opening concavity 106.

To this end, at the step of forming the plated film, the electrode film 102 positioned at the bottom of the opening concavity 106 is used as a seed to grow plated films 107, 107*a* (both films are the same; in the present disclosure, however, the plated film at the site needing film thickness precision is tentatively indicated by 107*a* for a better understanding of the invention) in such a way as to fill up the opening 106.

Figure 1G:
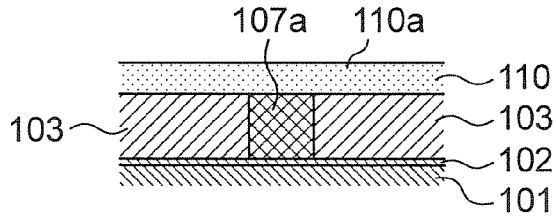
Figure 2G:
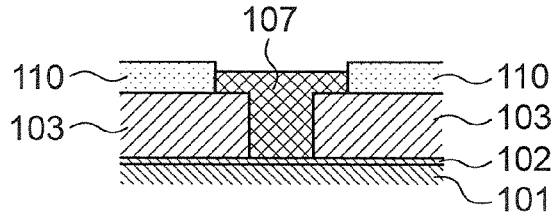

Upon the completion of formation of the plated films, the state depicted in FIG. 1G, and FIG. 2G is reached. In the invention, even after the opening concavity 106 is thoroughly filled up, the plated films still continue to grow, as depicted in FIG. 2G, and over-plating is going to be delimited by the shape of the dry resist pattern 110. Although that over-plating takes effect in such a range that the effectiveness of the invention is ensured, it is acceptable to increase the amount of over-plating intentionally, because there may be a composite shape of plated films obtained through a combination of the resist pattern formed on the electrode film and the pattern of the dry film resist.

In the invention, the part 110*a* of the dry film resist 110 is located at the upper position of the opening concavity 106 corresponding to the site needing film thickness precision in such a way as to cap it. After the opening concavity 106 is fully filled up with the plated film 107*a*, therefore, the thickness direction growth of plating at the position of the opening concavity 106 corresponding to the site needing film thickness precision is restricted by the part 110*a* of the capping dry film resist 110, with the result that the plated film 107*a* (FIG. 1G) at the site needing film thickness precision is much improved in terms of film thickness precision and much reduced in terms of a fluctuation of plated film thickness distribution.

As noted previously, at the step of forming the plated film according to the invention, even after the plated film 107*a* at the site needing film thickness precision has its thickness direction growth restricted by abutting thoroughly on the plane defined by the part 110*a* of the capping dry film resist 110, plating carries on a little while longer. This is to make sure the precision of the thickness of the plated film 107*a* at the site needing film thickness precision. For this reason, over-plating carries on at a site (an uncapped site of the dry film resist) with no restriction on the thickness direction growth of plating, so that an excessive plated film is formed along the pattern of the dry film resist pattern.

The composition of the plating bath used may be properly determined with the plated film to be formed in consideration, and plating conditions such as current density and bath temperature may just as well be properly determined, too.

(6) Step of Removing the Resists

Figure 1H:
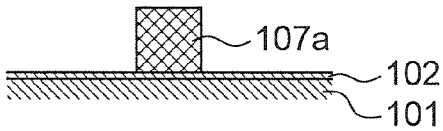
Figure 2H:
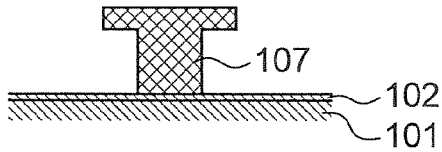

Following the plated film-formation step, there is the resist removal step of removing the resist pattern 103 and dry film resist pattern 110, as depicted in FIGS. 1H and 2H.

At the resist removal step, the resist pattern 103 and dry film resist pattern 110 are removed with the use of an organic solvent such as isopropyl alcohol (IPA), N-methyl-2-pyrrolidone (NMP) or acetone. As a result, there are the electrode film 102 and plated film 105 remaining on the substrate 101.

(7) Etching Step

Figure 1I:
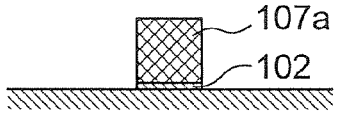
Figure 2I:
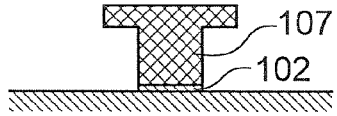

Following the resist removal step, there is the etching step carried out for removal of an unnecessary portion of the electrode film 102 using the plated films 107, 107*a* as a mask, as depicted in FIGS. 1I and 2I.

The etching used may be any of wet etching using an acidic or alkaline etchant, and dry etching such as sputter etching, active ion beam etching (RIE), and plasma etching. Which etching is used may be optionally determined in consideration of the physical properties of the plated film used as the mask, and the physical properties of the electrode film 102 to be etched.

The present invention is now explained in further details with reference to specific experiments.

EXAMPLES

Preparation of Example 1 Sample

There was an experiment carried out, in which the inventive frame plating process was used to form a plated film having the site needing film thickness precision, at which the thickness precision of the plated film is partly needed.

The frame plating process was carried out according to the following steps.

First of all, there was the silicon substrate 101 provided, having a size of 6 inches ϕ and a thickness of 1.2 mm.

Then, a 50 nm thick Cu film was formed by sputtering on the silicon substrate 101 into the electrode film 102.

Then, a liquid resist (AZ4000 Series (of the positive type) made by AZ Electo-Material Co., Ltd.) was spin coated on the surface of the Cu electrode film 102, after which it was prebaked at a temperature of 100° C. for 60 seconds into the resist film 103*a* having a thickness of 5 μm.

Then, exposure and development were performed under the following conditions:

[Exposure]

Aligner: NSR-i12TFH made by Nikon Cooperation
The mask used: Binary mask
Exposure conditions: NA=0.4 Sigma=0.6
Dose=1,000 mJ/cm$^2$
Focus=0 μm

[Development]

A developer comprising a 2.38% TMAH (tetramethyl anhydrite) aqueous solution was used for a 60-second development at five paddles.

The resist pattern was formed in such morphology as shown in FIG. 3. That is, the opening concavity 106 delimited by the resist pattern 103 had the morphology comprising the straight portion 102*a* having a decreased width, the fanning portion 102*b* joining to that decreased width portion 102*a* and having an increasing width and the portion 102*c* joining to the increasing width portion 102*b* and having an increased yet constant width. The width Wn of the straight portion 102*a* having a decreased width was set at 5 μm, and the site needing film thickness precision was set at substantially the middle of the straight portion 102*a* having a decreased width.

Then, the dry film resist 109 was roll coated (laminated) in such a way as to cover the whole of the resist pattern 103 and opening concavity 106.

The dry film resist 109 used was the Photec Series of Resist (of the negative type) made by Hitachi Kasei Co., Ltd. and having a thickness of 10 μm. For the roll coating of the dry film resist 109, the substrate 101 was heated at a temperature of 80° C. for 10 minutes, with a roll temperature of 110° C., a roll pressure of 0.4 Mpa, and a roll speed of 1.0 m/min.

Then, photolithography was used to pattern the dry film resist 109 into the dry resist pattern 110.

Exposure and development were performed under the following conditions:

[Exposure]

Aligner: Mask Aligner PLA-501 made by Canon Co., Ltd.

The mask used: Binary mask having the shape dotted in FIG. 4

Exposure conditions: NA=0.4 Sigma=0.6

Dose=15 mJ/cm$^2$

Focus=0 μm

[Development]

Development was implemented by a 20-second dipping in a developer comprising a 1% $Na_2CO_3$ aqueous solution.

The formed dry resist pattern 110 had such a general shape as shown by a dotted area in the plan view of FIG. 4. In FIG. 4, the part 110*a* of the dry resist pattern 110 played a role as the cap formed at the upper position of the opening concavity corresponding to the site needing film thickness precision, and had a width Wc of 3 μm.

Then, while the electrode film 102 was used as a seed, the plated films 107, 107*a* were formed on the electrode film 102.

That is, the plated film 107 having a Cu composition was grown to a thickness of 5.5 μm in such a way as to fill up the opening concavity 106. The plating system used was an opposite parallel anode paddle plating one with a copper sulfate plating bath. It is noted that at the upper position of the opening concavity 106 corresponding to the site needing film thickness precision, there was the part 110*a* of the dry resist pattern 110 present, which functioned as the cap: the thickness of the plated film 107*a* at that site was going to be limited to 5.0 μm.

Then, isopropyl alcohol (IPA) was used for removal of the resist pattern 103 and dry film resist pattern 110.

Then, the plated films 107, 107*a* were used as a mask and an aqueous solution containing 1% ferric chloride was used to dissolve off an unnecessary portion of the electrode film 102.

The thickness film distribution of the plated film 107*a* (thickness: 5 μm) corresponding to the site needing film thickness precision—the site that had to have the maximum precision throughout the plated film—was measured in the following way. It has thus been found that the film thickness distribution across the plane of the film was 1%, indicating that a fairly good film thickness distribution is obtained at the specific site 107*a* needing film thickness precision.

(How to Measure the film Thickness Distribution)

The film thicknesses of the 40 sites for measurement were measured at random by observation of sections by FIB (focused ion beam) made by FEI Co., Ltd.

From these measurement data, the thickness distribution is then found by

Thickness distribution=((Maximum thickness value−Minimum thickness value)/Average thickness value)×100(%)

Preparation of Comparative Example 1 Sample

Out of the steps of preparing the aforesaid sample of Example 1, there was the dry film resist pattern formation step omitted, at which the part 110*a* of the dry film resist 110 was located in such a way as to cap the upper position of the opening concavity 106 corresponding to the site needing film thickness precision. That is, without recourse to the dry film resist having a capping function, the frame pattern 103 shown in FIG. 3 was formed, after which frame plating was initiated to form a plated film of 5 μm in thickness.

As a result of measurement of the film thickness distribution of the thus formed sample of Comparative Example 1 at its site similar to that of the aforesaid sample of Example 1, the film thickness distribution across the plane of the film was 5%.

From the aforesaid results, the effectiveness of the invention would be appreciated. That is, the frame plating process of the invention comprises the dry film resist pattern formation step at which a part of the dry film resist is located in such a way as to cap the upper position of the given pattern of opening concavity corresponding to the site needing film thickness precision. With that frame plating process, it is thus possible to obtain a fairly good film thickness distribution at the specific site needing film thickness precision in a simple manner yet without depending on the film thickness distribution of the plated film based on plating conditions.

I claim:

1. A frame plating process for formation of a plated film having a site needing film thickness precision at which the plated film is partly required to have thickness precision, the process comprising:

providing a substrate, forming an electrode film on said substrate, forming a resist pattern on said electrode film in such a way as to provide a given pattern of opening concavity, coating the resist pattern, including the given pattern of opening concavity, with a dry film resist, wherein the dry resist film covers, but does not fill, the given pattern of opening concavity, performing photolithography on the dry film resist to form a dry resist pattern, and growing a plated film in such a way as to fill up said given pattern of opening concavity, wherein a part of the dry resist pattern acts to cap the given pattern of opening concavity.

2. The frame plating process according to claim 1, wherein there are plural patterns of opening concavity wherein there are as many parts of the dry resist pattern as said plural patterns of opening concavity, and wherein each of the plural patterns of opening concavity are capped, but not filled, by a part of the dry resist pattern.

3. The frame plating process according to claim 1, wherein said forming a resist pattern on said electrode film comprises placing a photo resist film on one surface of the substrate, and selectively exposing to light and developing the photo resist film to form the resist pattern including the given pattern of opening concavity.

4. The frame plating process according to claim 1, further comprising, after the growing, removing the resist pattern and the dry resist pattern.

5. The frame plating process according to claim 1, further comprising, after the growing, etching and removing an unnecessary portion of the electrode film using the plated film as a mask.

6. A frame plating process for formation of a plated film having a site needing film thickness precision at which the plated film is partly required to have thickness precision, the process comprising:

providing a substrate, forming an electrode film on said substrate, forming a resist pattern on said electrode film in such a way as to provide a given pattern of opening concavity, applying a patterned dry film resist, to which patterning has previously been applied, onto the resist pattern including the given pattern of opening concavity, wherein the patterned dry film resist covers, but does not fill, the given pattern of opening concavity, so that the upper position of said given pattern of opening concavity is capped by a part of said patterned dry film resist, and growing a plated film in such a way as to fill up said given pattern of opening concavity.

7. The frame plating process according to claim 6, wherein there are plural patterns of opening concavity, wherein there are as many parts of the patterned dry resist film as said plural patterns of opening concavity, and wherein each of the plural patterns of opening concavity are capped, but not filled, by a part of the patterned dry resist film.

8. The frame plating process according to claim 6, wherein said forming a resist pattern on said electrode film comprises placing a photo resist film on one surface of the substrate, and selectively exposing to light and developing the photo resist film to form the resist pattern including the given pattern of opening concavity.

9. The frame plating process according to claim 6, further comprising, after the growing, removing the resist pattern and the dry resist pattern.

10. The frame plating process according to claim 6, further comprising, after the growing, etching and removing an unnecessary portion of the electrode film using the plated film as a mask.

* * * * *